United States Patent [19]

Liebscher et al.

[11] 4,086,677

[45] May 2, 1978

[54] CLEANING DEVICE

[75] Inventors: Johannes Liebscher, Nassau, Lahn; Rolf G. Schülein, Singhofen, both of Germany

[73] Assignee: Leifheit International Gunter Leifheit GmbH, Nassau, Lahn, Germany

[21] Appl. No.: 662,934

[22] Filed: Mar. 1, 1976

[30] Foreign Application Priority Data

Mar. 4, 1975 Germany ..... 2509239

[51] Int. Cl.[2] ..... A47L 11/32

[52] U.S. Cl. ..... 15/42

[58] Field of Search ..... 15/41–48

[56] References Cited

U.S. PATENT DOCUMENTS 3,818,532 6/1974 Leifheit et al. ..... 15/42

FOREIGN PATENT DOCUMENTS 2,106,625 8/1971 Germany ..... 15/41 R 2,239,135 2/1974 Germany ..... 15/42

*Primary Examiner*—Edward L. Roberts

*Attorney, Agent, or Firm*—Michael J. Striker

[57] ABSTRACT

A cleaning device includes a housing having a frame including longitudinally spaced front and rear wall portions and transversely spaced lateral portions, and a plurality of support walls which extend in substantial parallelism with the lateral wall portions, on the one hand and with the front wall portion, on the other hand, and with spacing therefrom. The support walls are formed with bearing recesses which have open ends facing toward the surface to be cleaned when the cleaning device is in use, and at least one cover is provided which has respective closing portions which close the open ends of the bearing recesses and circumferentially complement the latter. The device further includes a plurality of wheels which engage the surface to be cleaned, and at least one cleaning body, such as a brush, which is mounted on the housing for rotation and driven into rotation in response to rotation of the wheels during the engagement of the latter with the surface to be cleaned. Each of the wheels is mounted on a shaft which is partly received in at least two of the above-mentioned bearing recesses and held therein by the closing portions of the cover. A connecting arrangement connects the cover to the frame of the housing. One or a pair of corner-sweeping brushes may also be mounted on the housing, at the front lateral regions thereof for rotation about a respective axis which extends from the housing toward the surface to be cleaned. One bearing for one end of a shaft of the corner-sweeping brush is formed in a support wall which extends substantially parallel to the surface to be cleaned, while the other end of the shaft is supported in a cover. The housing, including the frame and the support walls, is a one-piece body of injection-molded synthetic plastic material.

29 Claims, 12 Drawing Figures

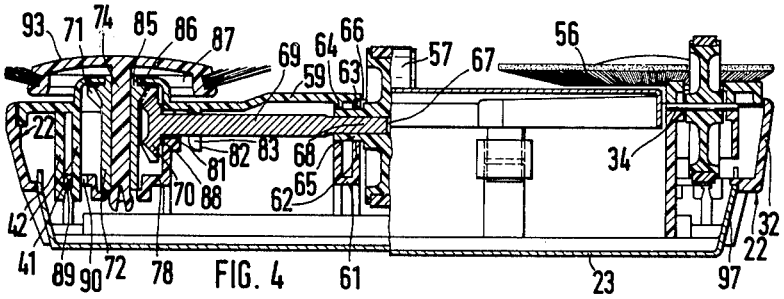
FIG. 4
FIG. 2
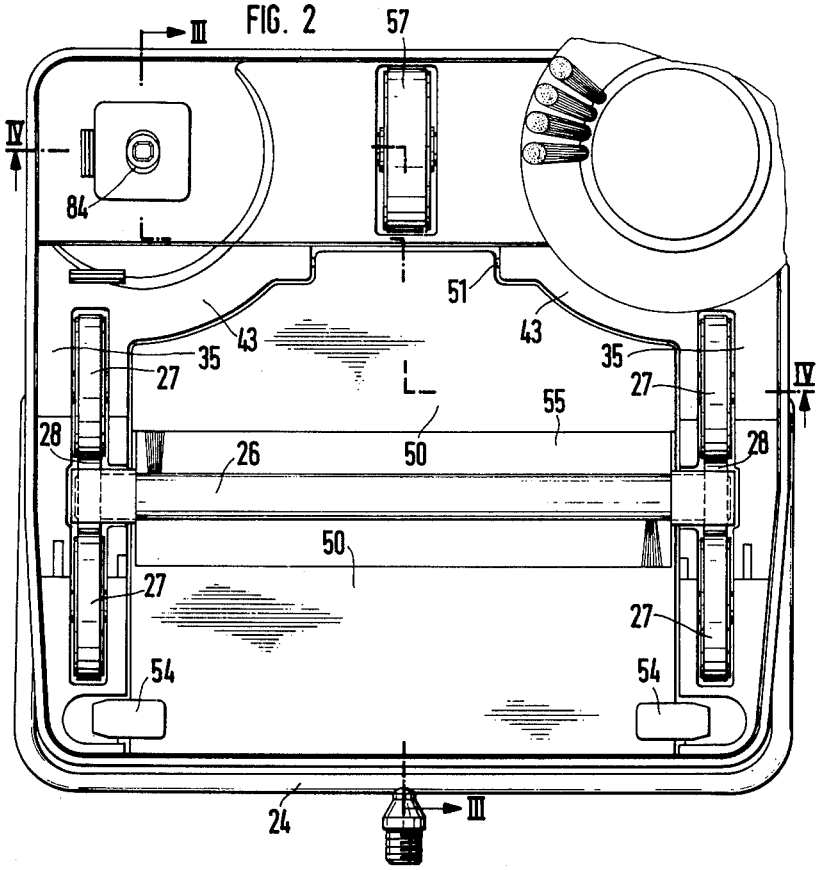

CLEANING DEVICE

BACKGROUND OF THE INVENTION

The present invention relates to a cleaning device in general, and more particularly to a floor-sweeping device of the type in which a cylindrical brush rotates about an axis which is transverse to the direction of movement of the device over the surface being cleaned, the cylindrical brush picking up dirt from the surface and depositing the same into at least one dirt-collecting receptacle.

Such floor-sweeping devices are already known and in widespread use and usually they include a housing in which there are mounted bearing elements for the shafts of driving wheels which rotate in engagement with the surface being cleaned and which drive the cylindrical brush into rotation about its axis. The housing usually includes a rigid circumferential frame, and the bearing elements for the shafts of the driving wheels are usually located in the lateral regions of the housing adjacent to the lateral wall portions of the circumferential frame. The conventional housing further includes a cover which closes that side of the housing which faces away from the surface to be swept during the use of the cleaning device.

In this conventional floor-sweeping device, the bearing elements are constituted as discrete elements which are separate from the housing and also separately manufactured, such bearing elements having guiding and connecting portions. The frame of the housing of this conventional floor-sweeping device then includes complementary guiding portions in which the guiding portions of the bearing elements are received, the connecting portions of the bearing elements connecting the same to the housing and preventing the bearing elements from displacing relative to the housing once they have been assembled with one another.

Experience with this type of floor-sweeping device has shown that the manufacture thereof is rather complex and consequently expensive for several reasons. First of all, it is necessary, in such a conventional floor-sweeping device, to separately produce the frame of the housing of the floor-sweeping device and the respective bearing elements, and then employ a separate assembling operation in which the bearing elements are introduced into the guiding portions of the frame of the housing, properly positioned in such guiding portions, and connected to the frame in such proper positions. On the other hand, the respective components which together form the housing, that is the frame and the bearing elements, must have sufficiently large wall thickness in order for the frame and the bearing elements to have the required rigidity, which is especially true when the various components are made of synthetic plastic material. The consumption of material is further increased by the need for providing the various guiding portions on the frame and on the bearing elements, which guiding portions then either cause or call for a further increase in the wall thickness of the various components. The increased material consumption not only increases the cost of manufacturing the device, but also makes the floor-cleaning device rather bulky, heavy and unwieldy.

SUMMARY OF THE INVENTION

Accordingly, it is a general object of the present invention to avoid the disadvantages of the prior art floor-sweeping devices.

More particularly, it is an object of the present invention to provide a cleaning device in which the housing can be manufactured in a simple and economical manner.

A further object of the present invention is to provide a cleaning device of the type here under discussion which is simple in construction and inexpensive to manufacture.

A concomitant object of the present invention is to so construct the housing of the floor-cleaning device that it can be manufactured in a simple way in one-piece, such as in an injection-molding operation.

Yet another object of the present invention is to provide a housing for use in a floor-sweeping device which is very light in weight but sufficiently rigid nevertheless.

It is a still further object of the present invention to provide a cleaning device the component parts of which can be very easily assembled.

In pursuance of these objects and others which will become apparent hereafter, one feature of the present invention resides, briefly stated, in a device for cleaning surfaces, in a combination which comprises a housing having a longitudinal and a transverse axis and transversely spaced lateral regions, the housing including a pair of support walls at each of the lateral regions of the housing, the support walls extending substantially parallel to the longitudinal axis of the housing with transverse spacing from one another. A plurality of wheels is mounted on the support walls intermediate the same for rotation in engagement with the surface to be cleaned, the mounting means for the wheels including bearing recesses in the support walls, having open ends facing toward the surface to be cleaned, mounting shafts for the wheels, having mounting portions supported in the bearing recesses, and at least one cover mounted on the housing and having closing portions which close the open ends of the bearing recesses. In the currently preferred embodiment of the invention, the housing further includes a frame which has longitudinally spaced front and rear wall portions and transversely spaced lateral wall portions, and the support walls are situated between the respective lateral wall portion of the frame and the longitudinal axis. The frame is thus open both toward and away from the surface to be cleaned, so that it can be manufactured in a simple manner in a simple mold, particularly since the pairs of the support walls which are provided with the bearing recesses which are open toward the surface to be cleaned, can be shaped or molded without encountering any difficulties. On the other hand, the provision of the support walls increases the stability of the frame so that the thickness of the frame, and particularly of the lateral wall portions thereof, can be much smaller than heretofore known. In this manner, a substantial saving of the material of which the housing is made is obtained.

According to a further concept of the present invention, the housing may further include a plurality of reinforcing wall portions which extend between and are rigidly connected with the respective lateral wall portions and the respective support walls of the housing. The reinforcing walls may extend not only between the support walls of each pair, but also between the inner ones of the support walls of the pairs of support walls which are located at opposite lateral regions of the housing. In this manner, the rigidity of the frame is further improved.

In a currently preferred embodiment of the present invention, the closing portions of the cover include complementary bearing recesses which are open toward and aligned with the bearing recesses of the support walls. In this manner, the mounting portions of the mounting shafts of the wheels are reliably received in the bearing recesses.

The cover is provided, in a known manner, with arresting arms which are formed with arresting projections cooperating with detent recesses and serving the purpose of detachably connecting the cover to the housing and support walls thereof. In this manner, a particularly simple assembling operation of the floor-sweeping device is obtained, particularly since it is merely sufficient to introduce the mounting portions of the mounting shafts of the wheels into the respective bearing recesses and then to connect a cover to the frame by means of the arresting arms. A simple pressing of the cover against the frame is sufficient to connect the cover to the frame. On the other hand, it is equally simply possible to disassemble the cover from the frame by simply deflecting the arresting arms to thereby discontinue the snap-action connection of the latter with the detent recesses of the frame.

In a currently preferred embodiment of the present invention, at least one cylindrical cleaning body is mounted in the housing for rotation about an axis which is substantially parallel to the transverse axis of the housing, and the wheels are in driving contact with the cylindrical cleaning body so as to rotate the same about the axis. In this embodiment, each complementary bearing recess and the associated bearing recess together form an elongated slot which is inclined with respect to a surface to be cleaned. Preferably, the elongated slot has one end which is closer to the cylindrical cleaning body and more spaced from the surface to be cleaned, and another and more spaced from the cylindrical cleaning body and closer to the surface to be cleaned so that the forces which act on the device during the use thereof displace the mounting portion of the mounting shaft toward the one end of the elongated slot and thus the respective wheel into driving engagement with the cylindrical cleaning body. In this manner, virtually skidless frictional engagement of the respective driving wheel with the cylindrical cleaning body is obtained. Preferably, the cleaning body is a cylindrical brush which has bristles in contact with the surface to be cleaned.

In a further currently preferred embodiment of the present invention, the housing includes a partitioning wall which extends substantially parallel to the transverse axis between the same and the front wall portion, and mounting walls extending between the partitioning wall and the front wall portion. This embodiment of the device of the present invention further comprises at least one corner-sweeping brush, at least one auxiliary wheel for driving the corner-sweeping brush, and means for supporting the corner-sweeping brush and the auxiliary wheel on the mounting walls so that the corner-sweeping brush rotates about a brush axis extending from the housing toward the surface to be cleaned. The supporting means of this embodiment supports the corner-sweeping brush at one of the lateral regions of the housing, and the corner-sweeping brush has bristles which extend radially outwardly of the brush axis and beyond the front wall portion and the respective lateral wall portion of the housing. In this manner, even the bearing for the corner-sweeping brush is likewise formed on the frame. The mounting walls of this embodiment can be formed or molded together with the frame in a simple manner, and the rigidity of the frame is further improved.

The partitioning wall, each inner of the support walls, and the rear wall portion of the housing together circumferentially bound a confining space, and at least one dirt-collecting receptacle is mounted within the confining space. In this manner, the respective support walls and partitioning walls separate the spaces accommodating the bearings for the respective wheels and the bearing for the corner-sweeping brush from the confining space so that the dirt accumulating in the latter is prevented from reaching and soiling such bearings.

The partitioning wall and the front wall portion of the housing together bound an enclosed space, and a closure closes the enclosed space in direction toward the surface to be cleaned. In this manner, the housing, which was originally open at its both ends facing either toward the surface to be cleaned or away from the same, obtains a closed appearance even in this region.

The closure is provided, in a known manner, with arresting arms which are equipped with arresting projections cooperating with detent recesses, for detachable connection of the closure to connecting portions of the housing. In this manner, the closure is also attached to the frame of the housing in an exceedingly simple manner.

It is further proposed by the present invention that the supporting means include at least one auxiliary bearing recess which has an open end facing toward the surface to be cleaned, and an auxiliary shaft for the auxiliary wheel which is partly received in the auxiliary bearing recess, the closure having at least one auxiliary closing portion which closes the open end of the auxiliary bearing recess. The closure may have additional mounting walls which are aligned with the above-mentioned mounting walls of the housing and provided with the contact portions, and the respective closing portion may have a shape such as to circumferentially complete the bearing for the auxiliary shaft of the auxiliary wheel. This assures a very simple mounting of the auxiliary shaft of the auxiliary wheel in the housing.

A further currently preferred embodiment of the present invention further comprises an additional corner-sweeping brush which is similar to the above-mentioned corner-sweeping brush, and the supporting means supports the corner-sweeping brush at one, and the additional corner-sweeping brush at the other lateral region of the housing. In this embodiment, the housing includes compartmentalizing walls which extend between the front wall portion and the partitioning wall and bound a compartment for partially receiving the auxiliary wheel. The cleaning device of this embodiment further comprises means for carrying the auxiliary wheel on the compartmentalizing walls which includes additional bearing recesses having open ends facing toward the surface to be cleaned, and an auxiliary mounting shaft partly received in the additional bearing recesses for rotation. In this embodiment, the corner-sweeping brush and the additional corner-sweeping brush each has a respective brush shaft; a bevel gear transmission is interposed between the auxiliary mounting shaft and each of the respective brush shafts and is operative for rotating the latter in response to rotation of the auxiliary shaft. As a result of this arrangement of the compartmentalizing walls, the auxiliary wheel is mounted in the housing in an especially simple manner, and also very reliably, especially when more than one compartmentalizing wall is arranged to each side of the auxiliary wheel. In the latter instance, the bearing for the auxiliary shaft is very wide, even though the individual compartmentalizing walls may be advantageously relatively thin.

According to a further advantageous concept of the present invention the closure includes additional compartmentalizing walls which are aligned with the compartmentalizing walls of the housing when the closure is attached to the housing, the closure being provided with a passage for the auxiliary wheel intermediate the adtitional compartmentalizing walls and having additional closing portions which close the open ends of the additional bearing recesses. Advantageously, the additional closing portions are so configurated as to circumferentially complete the bearing recesses for the auxiliary shaft. In this manner, the auxiliary shaft of the auxiliary wheel is supported in a relatively wide bearing from all sides thereof.

The corner-sweeping brush has a brush body and a brush shaft, and the mounting walls include at least one mounting wall portion which extends parallel to the surface to be cleaned. In this embodiment, the supporting means includes a bearing depression in the mounting wall portion adapted to receive an end portion of the brush shaft which is remote from the brush body. This mounting wall portion which extends parallel to the surface to be cleaned can also be provided in a simple manner and in a simple mold.

The supporting means further includes an annular reinforcing portion on the mounting wall portion, the reinforcing portion circumferentially surrounding the bearing depression provided in the mounting wall portion which extends parallel to a surface to be cleaned. This reinforcing portion can also be easily formed together with the remainder of the housing, also in a very simple mode.

Furthermore, the mounting walls may include at least one mounting wall section which extends between the partitioning wall and the front wall portion and substantially normal to the surface to be cleaned. The supporting means includes at least one further bearing recess which has an open end facing toward the surface to be cleaned, and an auxiliary shaft for the auxiliary wheel is partly received in the further bearing recess. In this embodiment, the closure has at least one further mounting wall section which is aligned with the mounting wall section of the housing when the closure is attached to the housing and which has a further closing portion which closes the open end of the further bearing recess. In this manner, the auxiliary shaft which connects the auxiliary wheel with the corner-sweeping brush is also mounted on the housing at its region which is close to the shaft of the corner-sweeping brush. The bearing for this auxiliary shaft in this region is also very easy to manufacture.

This embodiment for the present invention further comprises means for holding the corner-sweeping brush in the closure, the holding means including a bearing aperture in the closure for accommodating the end of the brush shaft which is close to the brush body. The brush body has an annular depression at the end thereof which faces the closure, and the closure has an outwardly bulging projection which is accommodated within the annular depression of the brush body and provided with the above-mentioned aperture. This bearing for the close end of the brush shaft can also be formed in a very simple manner on the closure.

The cleaning device of the present invention further comprises a protective cover for closing that end of the frame which faces away from the surface to be cleaned, the protective cover being of sheet metal. The profiled element has front and rear marginal portions which are inclined with respect to the remainder of the profiled element which forms the protective cover, and the frame includes clamping portions which receive and clamp the marginal portions of the profiled element. In this manner, that side of the frame of the housing which faces away from the surface to be cleaned can be closed in a very simple manner by merely pressing the sheet-metal profiled element against the frame of the housing.

The profiled element which constitutes the protective cover has lateral marginal portions which are inclined with respect to the remainder of the profiled element, the inclined marginal portions abutting against the lateral wall portions of the frame of the housing. In this manner, the floor-sweeping device of the present invention obtains a closed appearance at that side thereof which faces away from the surface being cleaned.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a bottom plan view of the device of FIG. 1, with one of the corner-sweeping brushes removed;

FIG. 4 is a sectional view taken on line IV—IV of FIG. 2;

DETAILED DISCUSSION OF THE PREFERRED EMBODIMENTS

Figure 1:
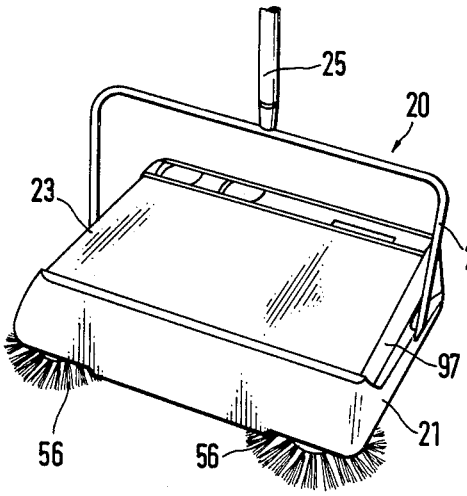
FIG. 1 is a perspective view of a cleaning device equipped with a pair of rotating corner-sweeping brushes.

Referring now to the drawings, and first to FIG. 1 thereof, it may be seen that the floor-sweeping device is designated in toto with the reference numeral 20. The floor-sweeping device 20 includes a housing 21 which includes a generally annular and circumferentially complete frame 22, and a cover 23 which is connected to the frame 22 and which closes that side of the frame 22 which faces away from the surface to be cleaned during the use of the device 20. The frame 22 is outwardly provided with receiving depressions in which end portions of a bracket 24 are accommodated. An elongated handle portion 25 is connected to the bracket 24 and serves the purpose of moving the floor-sweeping device 20 over the surface to be swept. The frame 22 circumferentially surrounds a space in which there are accommodated and mounted various brushes and also wheels which serve the purpose of mounting the housing 21 for movement over the surface to be swept and also for driving the various brushes. A cylindrical brush 26, illustrated in FIG. 2 is mounted in the frame 22 which serves the purpose of picking up dirt from the surface to be cleaned by the floor-sweeping device 20, the cylindrical brush 26 being mounted in the housing 21 for rotation about an axis which is transverse to the direction of movement of the housing 21 over the surface to be swept. The cylindrical brush 26 is driven into rotation with respect to the surface from which dirt is to be picked up by means of driving wheels 27 which are in driving frictional contact with portions of the cylindrical brush 26. For this purpose, the shaft of the cylindrical brush 26 is provided with enlarged end portions 28, and two of the driving wheels 27 are arranged frontwardly and rearwardly of the enlarged portions 28 at each lateral region of the housing 21, both of the respective two wheels 27 being in frictional contact with the enlarged end portion 28 of the shaft of the cylindrical brush 26.

Figure 6:
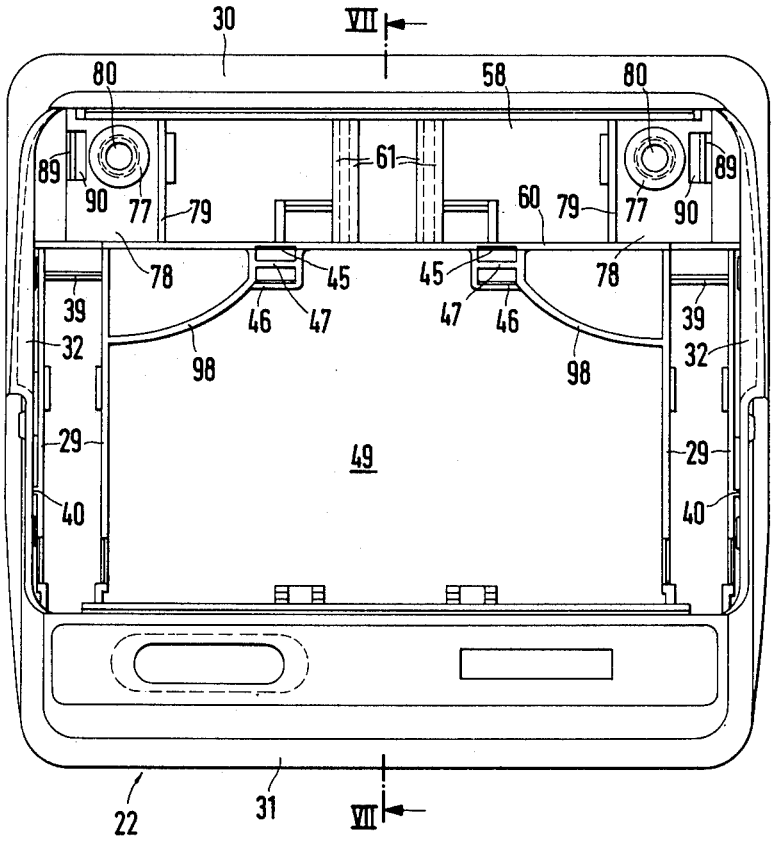
FIG. 6 is a top plan view of a frame of the cleaning device of FIG. 1.

The driving wheels 27 are supported on and guided in bearings which are formed on support walls 29, illustrated in FIG. 6, which are arranged in pairs at lateral regions of the frame 22 and which receive the driving wheels 27 between them. The frame 22 includes a front wall portion 30, a rear wall portion 31 and two lateral wall portions 32, and the support walls 29 increase the stability and rigidity of the frame 22. This means that the frame 22 and also the support walls 29 can be formed by relatively thin wall portions, whereby the consumption of the material of which the housing 21 is made is significantly reduced. The frame 22 and the support walls 29 are so designed that the housing 21 can be easily manufactured of synthetic plastic material, such as by injection molding. The frame 22 has two open sides, one facing toward and the other away from the surface to be cleaned during the use of the device 20. This open configuration of the housing 21 means that a simple injection-molding mold or die can be used.

The support walls 29 are provided with bearing recesses 33 (see FIGS. 7, 8) which are open toward the surface to be cleaned, the driving wheels 27 having respective shafts 34 which are received in the respective bearing recesses 33. Covers 35 close the frame 22 in the lateral regions thereof with respect to the surface to be swept. The covers 35 include closing portions which close the open ends of the bearing recesses 33 and thus hold the shafts 34 of the driving wheels 27 in the latter. The covers 35 are provided with openings 36 for the driving wheels 27, and the closing portions include complementary bearing recesses 37 which cooperate with the open bearing recesses 33 of the support walls 29 and are aligned therewith. The complementary bearing recesses 37 are provided on additional support walls 38 provided on the respective covers 35. Thus, when the device 20 is to be assembled, the shafts 34 of the driving wheels 27 are inserted into the bearing recesses 33 which are open toward that side of the housing 21 which faces toward the surface to be cleaned during the use of the device 20, and then the respective cover 35 is connected to the above-mentioned side of the housing 21. In this manner, the driving wheels 27 are reliably supported in the frame 22.

The support walls 29 which extend substantially parallel to the respective lateral wall portions 32 of the frame 22 are connected, by means of reinforcing walls 39, 40, with the lateral wall portions 32 of the frame 22 and/or with the support walls 29 which are located at the other side of the driving wheels 27. In this manner, the rigidity of the frame 22 is further increased.

The covers 35 are provided with arresting arms 42 which are equipped with arresting projections 41, the arresting arms 42 being arranged in pairs. The arresting arm 42 with their arresting projections 41 serve the purpose of detachably connecting the cover 35 to the support walls 29 and reinforcing walls 39. As particularly seen in FIG. 10, one such pair of arresting arms 42 is formed at the front end of the cover 31, which cooperates with the reinforcing wall 39 which interconnects the support walls 29 which, in turn, receive the driving wheels 27 between themselves. The pair of arresting arms 42 receives the reinforcing wall 39 between themselves in a positive connecting manner. The arresting projections 41 are provided at those sides of the arresting arms 42 which face one another and engage behind the side of the reinforcing wall 39 which faces away from the surface to be swept. When the cover 35 is to be detached from the frame 22, the arresting arms 42 are to be forced apart.

Figure 5:
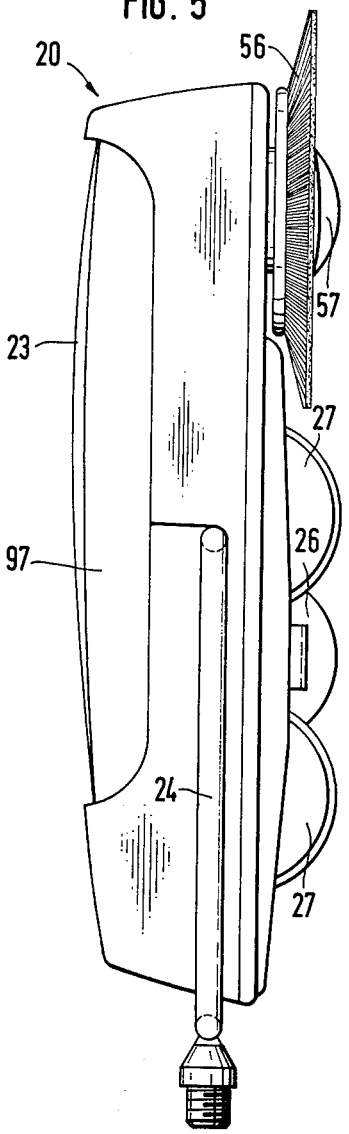
FIG. 5 is a side elevational view of the cleaning device of FIG. 1.
Figure 12:
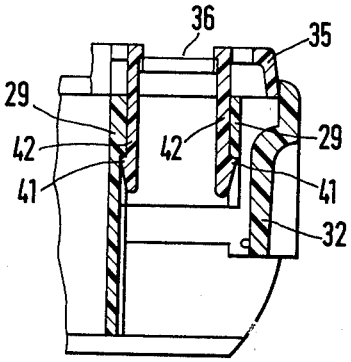
FIG. 12 is a partly fragmentized sectional view taken on line XII—XII of FIG. 8.

A further pair of arresting arms 42 is provided in the region of the rear end of the cover 35. In this arrangement, the arresting arms 42 are arranged at two sides of the opening 36 for the driving wheel 37, and they cooperate with the support walls 29 in a manner best illustrated in FIG. 5 which shows that the arresting projections 41 are located at those sides of the arresting arms 42 which face away from each other and cooperate with edge portions of the support walls 29. When the cover 35 is to be detached from the frame 22, these two arresting arms 42 are to be pressed toward each other at their free ends.

Figure 11:
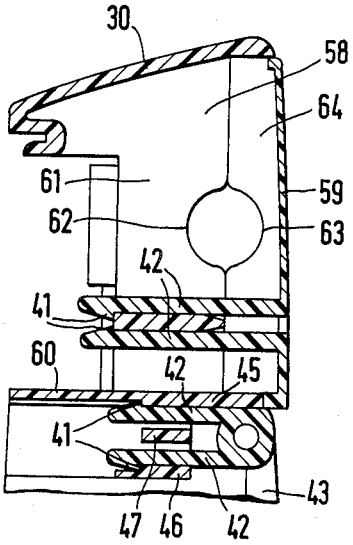
FIG. 11 is a cross-sectional view taken on line XI—XI of FIG. 8, partly fragmentized.

The covers 35 which are arranged at the two lateral regions of the floor-sweeping device 20 are provided, at their front ends, with a lateral extension 43 each, the lateral projections or extensions 43 extending toward the center of the floor-sweeping device 20. As best seen in FIG. 11, a further arresting arm pair 42 is arranged at the free ends of the extension 43, the arresting arms 42 cooperating with walls 45 and 46. The corresponding arresting projections 41 are arranged at those sides of the arresting arms 42 which face away from each other.

Furthermore, a dividing wall 37 is provided between the two arresting arms 42 in the holding position. When the cover 35 is to be detached from the frame 22, these arresting arms 42 are to be pressed toward each other at their free ends.

Figure 7:
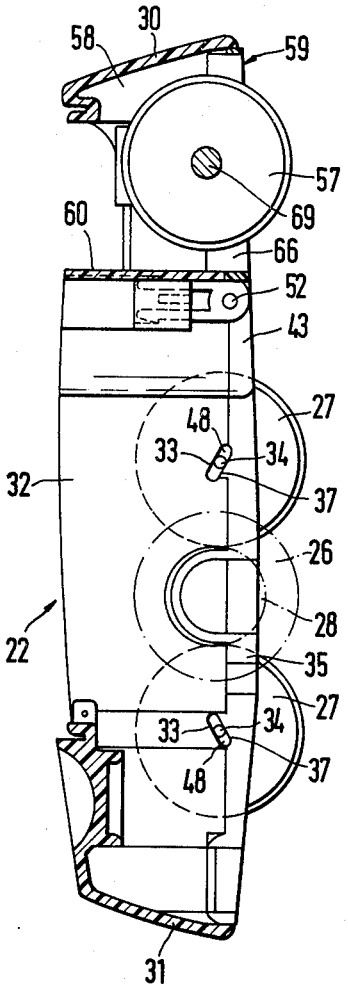
FIG. 7 is a cross-sectional view taken on line VII—VII of FIG. 6.
Figure 10:
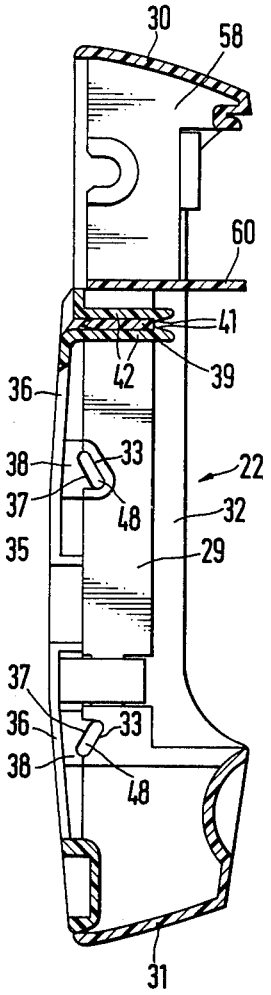
FIG. 10 is a sectional view taken on line X—X of FIG. 8.
Figure 9:
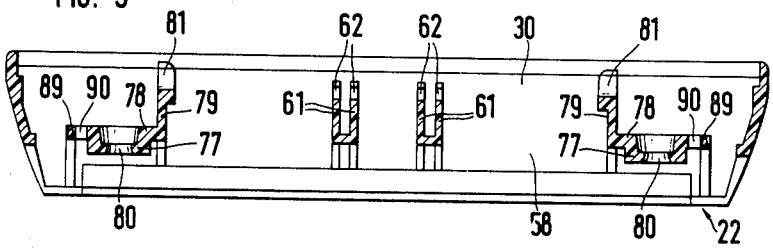
FIG. 9 is a sectional view taken on line IX—IX of FIG. 8.
Figure 8:
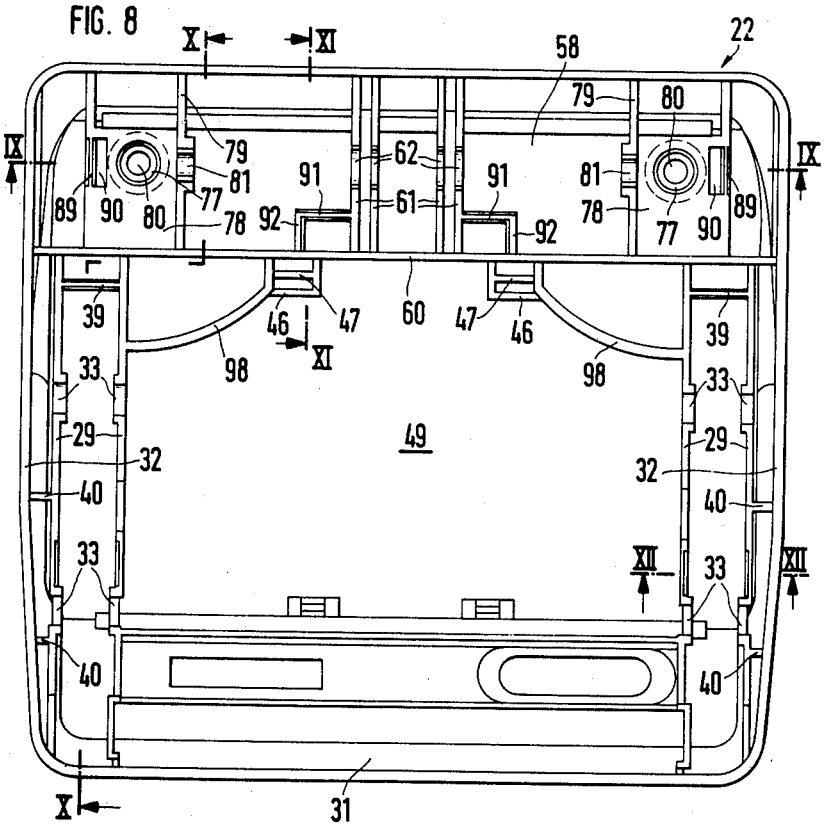
FIG. 8 is a bottom plan view of the frame of the cleaning device of FIG. 1.

As most clearly seen in FIGS. 7 and 10, each bearing recess 33 provided on the support wall 29 forms with the corresponding bearing recess 37 formed on the cover 35 an elongagted slot 48 which extends at an inclination to the surface to be swept, that end of the elongated slot 48 which is closer to the cylindrical brush 26 being more spaced from the surface to be cleaned than the end of the elongated slot 48 which is remote from the cylindrical brush 26. Because of this inclination of the slot 48, the driving wheels 27, when the floor-sweeping device 20 is pressed against the surface to be cleaned, are forcefully pressed against the enlarged end portion 28 of the shaft of the cylindrical brush 26 so that the driving wheels 27 frictionally force the cylindrical brush 26 to rotate about its longitudinal axis.

Dirt-collecting spaces 49 are provided in the frame 22 at two sides of the cylindrical brush 26, the dirt-collecting spaces 49 serving the purpose of collecting dirt which is picked up from the surface being swept by the cylindrical brush 26. The dirt-collecting spaces 49 are closable by a bottom wall 50 which is pivotable about an axis 51. The axis 51 is supported in holes 52 at its ends, the holes 52 being formed in mutually oppositely facing extensions 43 of the covers 35. Thus, when the cover 35 is assembled with the frame 22, the bottom wall 50 is simultaneously mounted in the housing 21. A spring 53 holds the bottom wall 50 in its operative position in which the free end of the bottom wall 50, together with projections 54 which serve the purpose of opening the bottom wall 50, abut against the end portion of the frame 22 which faces the surface from which dirt is to be removed. The bottom wall 50 is provided with an opening 55 for the cylindrical brush 26. In view of the fact that, when considered in the direction of movement of the cleaning device 20, one dirt-collecting space 49 is arranged frontwardly of the cylindrical brush 26 and another dirt-collecting space 49 is arranged rearwardly of the cylindrical brush 26, it is possible, during the operation of the device 20 which is moved over the surface to be cleaned in frontward and rearward directions of the housing, to deposit dirt in one or the other of the dirt-collecting spaces 49 depending on the direction of movement of the housing 21 over the surface to be cleaned since the change of direction of movement of the housing 21 over the surface to be cleaned simultaneously results in a change of direction of rotation of the driving wheels 27 about their axes and thus also in a change of direction of rotation of the cylindrical brush 26 about its axis.

Inasmuch as the cylindrical brush 26 can only pick up dirt from regions of the surface which are spaced a certain distance from the lateral wall portions 32 of the housing 21 of the floor-sweeping device 20, corner-sweeping brushes 36 are provided which are operative primarily in the above-mentioned lateral regions of the housing 21, by means of which corner-sweeping brushes 56 dirt can be lifted off from the surface even in the lateral regions of the housing 21 which renders possible complete cleaning of the surface to be cleaned, that is, even in the regions of corners of such surface.

In the illustrated embodiment, one of such corner-sweeping brushes 56 is arranged at each of the front corner regions of the floor-sweeping machine 20 in such a manner that each of the corner-sweeping brushes 56 is mounted on the housing 21 for rotation about an axis which is substantially normal to the surface to be swept during the operation of the device 20, and each having an essentially cup-shaped annulus of bristles which extends radially outwardly and toward the surface to be cleaned, the ends of the bristles reaching beyond the effective pick-up region of the cylindrical brush 26 on the one hand, and beyond the front wall region and the respective lateral wall region of the housing 21.

The corner-sweeping brushes are coupled with a driving wheel 57 so that the corner-sweeping brushes 56 rotate in response to the rotation of the driving wheel 57. The driving wheel 57 and the two corner-sweeping brushes 56 are provided in a space 58 arranged at the front wall portion 30 of the frame 22 of the housing 21. A closure 59 is provided which closes the space 58 with respect to the surface to be cleaned. The space 58 is separated from the dirt-collecting receptacles 49 by a partitioning wall 60 which extends parallel to the front wall portion 30 of the frame 22. Thus, the dirt-collecting space 49 is bounded by the partitioning wall 60 which extends parallel to the front wall portion 30 of the frame 22, and the inner one of the pair of support walls 29 which receive the driving wheels 27 between themselves, and the rear wall portion 31 of the frame 22. The corner regions between the partitioning wall 60 and the support walls 29 which are aligned with the extensions 43, are delimited by arcuate delimiting walls 98 and thus separated from the dirt-collecting receptacle 49. The corner regions which are in alignment with the extensions 43 are also in alignment with the bristle annuli of the corner-sweeping brushes 56. In other words, the bottom wall 50 which closes the dirt-collecting space 49 in direction toward the surface being swept, does not reach into the effective operating region of the respective corner-sweeping brush 56.

Pairs of compartmentalizing walls 61 extend between the front wall portion 30 of the frame 22 and the partitioning wall 60 which extends parallel to the front wall portion 30. The compartmentalizing walls 61 have open bearing recesses 62 for mounting portions 65 of the driving wheel 57.

The closure 59 is formed with an opening 66 for the driving wheel 57, and with pairs of additional compartmentalizing walls 64 at the two sides of the opening 66, which additional compartmentalizing walls 54 are aligned with the compartmentalizing walls 61 of the frame 22 and are formed with open bearing recesses 63 which cooperate with the bearing recesses 62 of the compartmentalizing walls 61.

Figure 3:
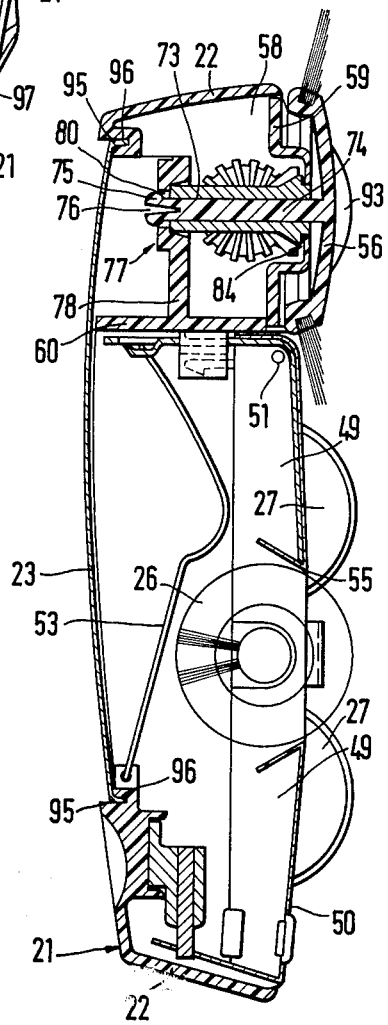
FIG. 3 is a sectional view taken on line III—III of FIG. 2.

The driving wheel 57 is formed with an axial opening 67 of a non-circular cross section. Free ends 68 of shafts 69, which have corresponding non-circular cross sections, are introduced into the opening 67 from both sides of the driving wheel 57 and thus connected to the latter for shared rotation therewith. The shafts 69 serve the purpose of connecting the driving wheel 57 with the respective corner-sweeping brushes 56. The ends of the shafts 69 which are remote from the driving wheel 57 are provided each with one bevel gear 70. Each bevel gear 70 cooperates and meshes with an additional bevel gear 71 which is formed on a driving sleeve 72. As particularly seen in FIGS. 3 and 4, the driving sleeve 72 is mounted for rotation in a part of the frame 22 which will be discussed in more detail later, the driving sleeve 72 extending substantially normal to the surface from which dirt is to be removed.

The driving sleeve 72 has a longitudinally extending receiving space 73 which serves the purpose of accommodating a corresponsing pin 74 of the additional corner-sweeping brush 56 therein. The pin 74 of the corner-sweeping brush 56 is mounted in the driving sleeve 72 for limited displacement axially of the latter, and it is connected to the driving sleeve 72 for shared rotation therewith. The pin 74 of the corner-sweeping brush 56 is mounted on the driving sleeve 72 in such a manner that an enlarged portion 75 provided at the free end of the pin 74 has a larger diameter than the inner diameter of the driving sleeve 72, while an axial slot 76 is provided in the enlarged region so as to be able to compress the enlarged region of the pin 74. In this manner, when the pin 74 of the additional corner-sweeping brush 56 is introduced into the driving sleeve 72, the enlarged region 75 of the pin 74 is resiliently compressed so that the enlarged region 75 assumes its original position after the passage of the free end portion of the pin 74 through the driving sleeve 72, whereby the pin 74 is connected to the driving sleeve 72 in the proper operative position thereof. It is to be added that, in the currently preferred embodiment of the present invention, the part of the pin which is located between the enlarged portion 75 and the body of the corner-sweeping brush 56 is somewhat longer than the driving sleeve 72. In this manner, the corner-sweeping brush 56 can conduct limited axial movements relative to the driving sleeve 72 which compensates for the uneveness of the surface which is to be swept.

The driving sleeve 72 has a cylindrical end portion which is remote from the body of the corner-sweeping brush 56, which end is received in an essentially cup-shaped depression 77 provided in a mounting wall portion 78. The mounting wall portion 78 extends essentially parallel to the surface to be swept, is accessible from above and from below, and is formed on the partitioning wall 50 which extends parallel to the front wall portion 30 of the frame 22 and further partitioning wall 79 which is located between the partition wall 60 and the front wall portion 30. Thus, the mounting wall portion 78 is formed in a very simple manner of one piece with the frame 22 and further increases the rigidity of the frame 22. The cup-shaped depression 77 has a surface which conically diverges toward the body of the corner-sweeping brush, the outer diameter of the driving sleeve 72 essentially corresponding to the smallest inner diameter of the conical depression 77. An opening is provided in the bottom of the cup-shaped depression 77 which accommodates the free end of the pin 74 which extends beyond the driving sleeve 38. The conical configuration of the depression 77 renders possible a limited tilting of the driving sleeve 72 and thus of the corner-sweeping brush 56, as will be described later.

The additional mounting wall 79 which is of one piece with the mounting wall portion 78 and is located between the front wall portion 30 of the frame 22 and the partitioning wall 60 which extends parallel to the front wall portion 30, is provided with a bearing recess 81 for the shaft 69 of the auxiliary driving wheel 57. The closure 59 which closes the frame 22 in this region in direction toward the surface being swept is provided with an additional mounting wall 82 which is formed with a bearing recess 83 which is open away from the surface to be swept, the additional mounting wall 82 being located adjacent to the partitioning wall 79, so that the shaft 69 which connects the additional driving wheel 57 with the corner-sweeping brush 56 is reliably supported in the bearing recesses 81 and 83.

The driving sleeve 72 is further mounted in the region of the body of the additional corner-sweeping brush 56, at the closure 59. The bearing for this end of the driving sleeve 72 is constituted by an elongated slot 84. The slot 84 is elongated in the direction of movement of the floor-sweeping device 20 over the surface being swept. The elongated slot 84 has such dimensions that the driving sleeve 72 can move from a central position by 1 millimeter forwardly and rearwardly. The end of the driving sleeve 72 which cooperates with the elongated slot 84 includes a cylindrical portion 85 which forms an annular shoulder 86. The annular shoulder 86 abuts against the closure 59 around the elongated slot 84. In this manner, the driving sleeve 72 is reliably held between the wall portion 78 and the closure 59. The assembly of the corner-sweeping brush 56 with the housing 20 is very simple in that the driving sleeve 72 is merely to be introduced into the cup-shaped depression 77 of the mounting wall portion 78, and then subsequently the closure 59 is to be connected to the frame 22 of the housing 21.

The closure 59 which is provided with the elongated slot 84 is formed in the region of the bearings with an outwardly bulging portion which is received in an annular depression 87 provided in that side of the corner-sweeping brush 56 which faces the closure 59. In this manner, the overall height of the floor-sweeping device 20 from the surface to be cleaned is substantially reduced.

As already mentioned, the shafts 69 are provided, at their end portions which are remote from the auxiliary driving wheel 57, with bevel gears 70 which cooperate and mesh with the bevel gears 71 of the driving sleeves 72. The bevel gear 70 which is mounted on the shaft 69 for shared rotation therewith abuts against the additional mounting wall 79 with a bearing surface 88 provided at the rear end thereof. In this manner, the bevel gear 70, and thus the additional shaft 69, are reliably mounted in the housing 21 and held against axial displacement.

The closure 59 is connected to the frame 22 with pairs of snap-action arresting arms 42 which are equipped with arresting projections 41. One pair of arresting arms 42 is arranged at each end of the closure 59 and cooperates with a portion 89 which is formed on the mounting wall portion 78 by an opening 90. The arresting projections 41 are provided on those sides of the arresting arms 42 which face away from each other. A similar pair of arresting arms 42 is arranged to the right and to the left of the opening 66 for the auxiliary driving wheel 57. These pairs of arresting arms 42 cooperate with portions 91 which are formed on the compartmentalizing walls 61 and are connected to the partitioning wall 60 by means of brackets 92. Even on these arresting arm pairs 42, the arresting projections 41 are arranged at the oppositely facing side of the arresting arms 42. When the closure 59 is to be detached from the frame 22, the free ends of the respective arresting arms 42 are to be pressed toward each other. For connecting the closure 59 to the frame 22, the arresting projections 41 are provided with chamfered front edge portions, and the brackets and other portions which cooperate with the arresting projections 41 also have inclined surfaces so that an arresting cooperation of the various components is obtained following a simple pressing of the closure 59 against the frame 22.

The body of the corner-sweeping brush 56 has a ball-shaped surface 93. These ball-shaped surfaces of the corner-sweeping brushes 56 abut against the surface from which dirt is to be removed. Thus, when the floor-sweeping device 20 is moved over the surface of to be cleaned, the body of the corner-sweeping brush 56 is retained by the friction between the same and the surface to be cleaned so that the corner-sweeping brush 56 is slightly displaced within the confines of the elongated slot 84 in the rearward direction when considered in the instantaneous direction of movement of the housing 21 of the surface to be swept. As a result of this, the portion of the annulus of bristles of the corner-sweeping brush 56 which is located frontwardly when considered in the direction of movement of the housing 21 over the surface, is in brushing contact with the surface, while the portion of the annulus of bristles which is rearward when considered in the direction of movement of the housing 21 over the surface to be swept, is slightly lifted from such surface. The driving movement of the driving wheel 57 is so transmitted to and converted into rotation of the corner-sweeping brush 56 that the portion of the annulus of bristles of the corner-sweeping brush 56 which is in sweeping or brushing contact with the surface to be swept, moves toward the center of the floor-cleaning device 20 so that the dirt is forwarded from the lateral regions of the housing 21 to the path of effective movement of the cylindrical brush 26. Thus, the cylindrical brush 26 is capable of picking up also such additional dirt coming from the lateral regions of the housing and depositing the same into the dirt-collecting receptacles 49. In view of the fact that the floor-sweeping device 20 conducts movements in frontward and rearward directions during the use thereof for cleaning a surface, further in view of the fact that such movement of the housing 21 results in corresponding rotation of the driving wheels 27 and 57 as well as concomitant reversal of the direction of rotation of the brushes 27 and 56, and further in view of the fact that the effective portion of the annulus of bristles of the additional corner-sweeping brushes 56 is in contact with the surface to be cleaned which portion rotates always in direction toward the center of the device 20, the dirt which is located in the regions which are outside of the path of effective cleaning of the cylindrical brush 26 is constantly moved toward the cylindrical brush 26 by the additional corner-sweeping brushes 56 in each movement phase of the device 20, so that the additional corner-sweeping brushes 56 can conduct sweeping operations regardless of the direction of movement of the housing 21 over the surface to be cleaned. As a result of the mirror-image arrangement of the corner-sweeping brushes 56 in both front corner regions of the floor-cleaning device 20, such regions of the surface to be cleaned can be reached during the movement of the housing 21 over such surface which are located to both sides of the path of movement of the cylindrical main brush 26, such as regions along baseboards or furniture bases.

As already mentioned above, the frame 22 is upwardly open and can be closed by means of a protective cover 23 which is constituted by a profiled sheet-metal element. The cover 23 includes front and rear marginal portions inclined with respect to the remainder of the profiled element 23, and the frame 22 includes clamping slots 76 in which the inclined marginal portions 95 of the profiled protective cover 23 are received and clamped. The protective cover 23 is further provided with inclined marginal portions 97 at the lateral portions thereof, such marginal portions 97 abutting against the lateral wall portions 32 of the frame 22.

It will be understood that each of the elements described above, or two or more together, may also find a useful application in other types of constructions differing from the types described above.

While the invention has been illustrated and described as embodied in a floor-sweeping device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a device for cleaning surfaces, a combination comprising a housing having a longitudinal and a transverse axis and transversely spaced lateral regions, said housing including a frame having longitudinally spaced front and rear wall portions and transversely spaced lateral wall portions, a pair of support walls at each of said lateral regions between the respective lateral wall portion and said longitudinal axis and extending substantially parallel to said longitudinal axis with transverse spacing from one another, a partitioning wall extending substantially parallel to said transverse axis between the same and said front wall portion and bounding an enclosed space with the latter, and mounting walls extending between said partitioning wall and said front wall portion; a plurality of wheels; means for mounting said wheels on said support walls intermediate the same for rotation in engagement with the surface to be cleaned, including bearing recesses in said support walls having open ends facing towards the surface to be cleaned, mounting shafts for said wheels having mounting portions supported in said bearing recesses, and at least one cover mounted on said housing and having closing portions which close said open ends of said bearing recesses; at least one corner-sweeping brush at least one auxiliary wheel for driving said corner-sweeping brush; means for supporting said corner-sweeping brush and said auxiliary wheel on said mounting walls for rotation of the former about a brush axis which extends from said housing toward the surface to be cleaned, including at least one auxiliary bearing recess which has an open end facing toward the surface to be cleaned, and an auxiliary shaft for said auxiliary wheel partly received in said auxiliary bearing recess; and a closure for closing said enclosed space in direction toward the surface to be cleaned, having at least one auxiliary closing portion which closes said open end of said auxiliary bearing recess.

2. In a device for cleaning surfaces, a combination comprising a housing having a longitudinal and a transverse axis and transversely spaced lateral regions, said housing including a frame having longitudinally spaced front and rear wall portions and transversely spaced lateral wall portions, a pair of support walls at each of said lateral regions between the respective lateral wall portion and said longitudinal axis and extending substantially parallel to said longitudinal axis with transverse spacing from one another, a partitioning wall extending substantially parallel to said transverse axis between the same and said front wall portion and bounding and enclosed space with the latter, and mounting and compartmentalizing walls extending between said partitioning wall and said front wall portion, said compartmentalizing walls bounding a compartment; a plurality of wheels; means for mounting said wheels on said support walls intermediate the same for rotation in engagement with the surface to be cleaned, including bearing recesses in said support walls having open ends facing toward the surface to be cleaned, mounting shafts for said wheels having mounting portions supported in said bearing recesses, and at least one cover mounted on said housing and having closing portions which close said open ends of said bearing recesses; two corner-sweeping brushes; at least one auxiliary wheel partially received in said compartment and operative for driving said corner-sweeping brushes; means for supporting each of said corner-sweeping brushes on said mounting walls at one of said lateral regions about respective brush axes which extend from said housing toward the surface to be cleaned and for supporting said auxiliary wheel on said mounting walls; means for carrying said auxiliary wheel on said compartmentalizing walls, including additional bearing recesses having open ends facing toward the surface to be cleaned, an auxiliary mounting shaft partly received in said additional bearing recesses for rotation, and means for closing said open ends of said additional bearing recesses; and a closure for closing said enclosed space in direction toward the surface to be cleaned.

3. A combination as defined in claim 2; wherein said corner-sweeping brushes has respective brush shafts; and further comprising bevel gear transmission means interposed between said auxiliary mounting shaft and said respective brush shafts and operative for rotating the later in response to rotation of said auxiliary shaft.

4. A combination as defined in claim 2, wherein said closure includes additional compartmentalizing walls which are aligned with said compartmentalizing walls of said housing when the closure is attached to said housing, said closure being provided with a passage for said auxiliary wheel intermediate said additional compartmentalizing walls and having additional closing portions which close said open ends of said additional bearing recesses.

5. In a device for cleaning surfaces, a combination comprising a housing having a longitudinal and a transverse axis and transversely spaced lateral regions, said housing including a frame having longitudinally spaced front and rear wall portions and transversely spaced lateral wall portions, a pair of support walls at each of said lateral regions between the respective lateral wall portion and said longitudinal axis and extending substantially parallel to said longitudinal axis with transverse spacing from one another, a partitioning wall extending substantially parallel to said transverse axis between the same and said front wall portion and bounding an enclosed space with the latter, and mounting walls extending between said partitioning wall and said front wall portion, including at least one mounting wall section extending between said partitioning wall and said front wall portion and substantially normal to the surface to be cleaned; a plurality of wheels; means for mounting said wheels on said support walls intermediate the same for rotation in engagement with the surface to be cleaned, including bearing recesses in said support walls having open ends facing toward the surface to be cleaned, mounting shafts for said wheels having mounting portions supported in said bearing recesses, and at least one cover mounted on said housing and having closing portions which close said open ends of said bearing recesses; at least one corner-sweeping brush; at least one auxiliary wheel for driving said corner-sweeping brush; means for supporting said corner-sweeping brush and said auxiliary wheel on said mounting walls for rotation of the former about a brush axis which extends from said housing toward the surface to be cleaned, including at least one further bearing recess which has an open end facing toward the surface to be cleaned, and an auxiliary shaft for said auxiliary wheel partly received in said further bearing recess; and a closure for closing said enclosed space in direction toward the surface to be cleaned, having at least one further mounting wall section aligned with said mounting wall section of said housing when the closure is attached to said housing and having a further closing portion which closes said open end of said further bearing recess.

6. In a device for cleaning surfaces, a combination comprising a housing having a longitudinal and a transverxe axis and transversely spaced lateral regions, said housing including a frame having longitudinally spaced front and rear wall portions and transversely spaced lateral wall portions, a pair of support walls at each of said lateral regions between the respective lateral wall portion and said longitudinal axis and extending substantially parallel to said longitudinal axis with transverse spacing from one another, a partitioning wall extending substantially parallel to said transverse axis between the same and said front wall portion and bounding an enclosed space with the latter, and mounting walls extending between said partitioning wall and said front wall portion, including at least one mounting wall portion which extends parallel to the surface to be cleaned; a plurality of wheels; means for mounting said wheels on said support walls intermediate the same for rotation in engagement with the surface to be cleaned, including bearing recesses in said support walls having open ends facing toward the surface to be cleaned, mounting shafts for said wheels having mounting portions supported in said bearing recesses, and at least one cover mounted on said housing and having closing portions which close said open ends of said bearing recesses; at least one corner-sweeping brush having a brush body and a brush shaft; at least one auxiliary wheel for driving said corner-sweeping brush; means for supporting said corner-sweeping brush and said auxiliary wheel on said mounting walls for rotation of the former about a brush axis which extends from said housing toward the surface to be cleaned, including a bearing depression in said mounting wall portion adapted to receive an end portion of said brush shaft which is remote from said brush body; a closure for closing said enclosed space in direction toward the surface to be cleaned; and means for holding said corner-sweeping brush in said closure, including a bearing aperture in said closure for accommodating the end of said brush shaft which is close to said brush body.

7. A combination as defined in claim 6 wherein said brush body has an annular depression at the end thereof which faces said closure; and wherein said closure has an outwardly bulging portion which is accommodated within said annular depression of said brush body and provided with said aperture.

8. In a device for cleaning surfaces, a combination comprising a housing having a longitudinal and a transverse axis and transversely spaced lateral regions, said housing including a frame having longitudinally spaced front and rear wall portions and transversely spaced lateral wall portions and means of one piece with said frame for reinforcing the same, including a pair of support walls at each of said lateral regions between the respective lateral wall portion and said longitudinal axis and extending substantially parallel to said longitudinal axis with transverse spacing from one another, a partitioning wall extending substantially parallel to said transverse axis between the same and said front wall portion, and mounting walls extending between said partitioning wall and said front wall portion; at least one cylindrical cleaning body mounted in said housing for rotation about an axis which is substantially parallel to said transverse axis of said housing; a plurality of wheels which are in driving contact with said cylindrical cleaning body so as to rotate the same about said axis; and means for mounting said wheels on said support walls intermediate the same for rotation in engagement with the surface to be cleaned, including bearing recesses in said support walls having open ends facing toward the surface to be cleaned, mounting shafts for said wheels having mounting portions supported in said bearing recesses, and at least one cover mounted on said housing and having closing portions which close said open ends of said bearing recesses and which include complementary bearing recesses which are open toward and aligned with said bearing recesses of said support walls, each complementary bearing recess and the associated bearing recess together forming an elongated slot.

9. A combination as defined in claim 8, wherein said elongated slot is inclined with respect to the surface to be cleaned.

10. A combination as defined in claim 9, wherein said elongated slot has one end which is closer to said cylindrical cleaning body and more spaced from the surface to be cleaned, and another end more spaced from the cylindrical cleaning body and closer to the surface to be cleaned so that the forces acting on the device during the use thereof displace said mounting portion of said mounting shaft toward said one end of said elongated slot and thus the respective wheel into driving engagement with said cylindrical cleaning body.

11. A combination as defined in claim 10, wherein said cylindrical cleaning body is arranged intermediate two of said wheels at each of said lateral regions of said housing.

12. In a device for cleaning surfaces, a combination comprising a housing having a longitudinal and a transverse axis and transversely spaced lateral regions, said housing including a frame having longitudinally spaced front and rear wall portions and transversely spaced lateral wall portions and means of one piece with said frame for reinforcing the same, including a pair of support walls at each of said lateral regions between the respective lateral wall portion and said longitudinal axis and extending substantially parallel to said longitudinal axis with transverse spacing from one another, a partitioning wall extending substantially parallel to said transverse axis between the same and said front wall portion, and mounting walls extending between said partitioning wall and said front wall portion; a plurality of wheels; means for mounting said wheels on said support walls intermediate the same for rotation in engagement with the surface to be cleaned, including bearing recesses in said support walls having open ends facing toward the surface to be cleaned, mounting shafts for said wheels having mounting portions supported in said bearing recesses, and at least one cover mounted on said housing and having closing portions which close said open ends of said bearing recesses; at least one corner-sweeping brush; at least one auxiliary wheel for driving said corner-sweeping brush; and means for supporting said corner-sweeping brush and said auxiliary wheel on said mounting walls so that said corner-sweeping brush rotates about a brush axis which extends from said housing toward the surface to be cleaned.

13. A combination as defined in claim 12, wherein said supporting means supports said corner-sweeping brush at one of said lateral regions of said housing; and wherein said corner-sweeping brush has bristles which extend radially outwardly of said brush axis and beyond said front wall portion and the respective lateral wall portion.

14. A combination as defined in claim 12, wherein said partitioning wall, each inner of said support walls, and said rear wall portion of said housing together circumferentially bound a confining space; and further comprising at least one dirt-collecting receptacle in said confining space.

15. A combination as defined in claim 12, wherein said partitioning wall and said front wall portion of said housing together bound an enclosed space; and further comprising a closure which closes said enclosed space in direction toward the surface to be cleaned.

16. A combination as defined in claim 15; and further comprising means for attaching said closure to said housing, including elastically yieldable arms having projections which engage in detent recesses with snap action.

17. A combination as defined in claim 12, wherein said corner-sweeping brush has a brush body and a brush shaft; wherein said mounting walls include at least one mounting wall portion which extends parallel to the surface to be cleaned; and wherein said supporting means includes a bearing depression in said mounting wall portion adapted to receive an end portion of said brush shaft which is remote from said brush body.

18. A combination as defined in claim 17, wherein said supporting means further includes an annular reinforcing portion on said mounting wall portion which circumferentially surrounds said bearing depression.

19. In a device for cleaning surfaces, a combination comprising a housing having a longitudinal and a transverse axis and transversely spaced lateral regions, said housing including a frame having longitudinally spaced front and rear wall portions and transversely spaced lateral wall portions which together circumferentially bound an interior, and means for reinforcing and of one piece with said frame, including a pair of reinforcing support walls at each of said lateral regions between the respective lateral wall portion and said longitudinal axis and extending substantially parallel to said longitudinal axis with transverse spacing from one another, a reinforcing partitioning wall extending substantially parallel to said transverse axis between the same and said front wall portion and bounding with each inner of said support walls and with said rear wall portion a confining space and with said front wall portion an enclosed spaced in said interior, and reinforcing mounting walls extending in said enclosed space between said reinforcing partitioning wall and said front wall portion; a plurality of wheels; and means for mounting said wheels on said support walls intermediate the same for rotation in engagement with the surface to be cleaned, including bearing recesses in said support walls having open ends facing toward the surface to be cleaned, mounting shafts for said wheels having mounting portions supported in said bearing recesses, and at least one cover mounted on said housing and having closing portions which close said open ends of said bearing recesses.

20. A combination as defined in claim 19, wherein said housing further includes a plurality of reinforcing wall portions extending between and rigidly connected with the respective lateral wall portions and the respective support walls of said housing.

21. A combination as defined in claim 19, wherein said closing portions of said cover include complementary bearing recesses which are open toward and aligned with said bearing recesses of said support walls.

22. A combination as defined in claim 21, and further comprising at least one cylindrical cleaning body mounted in said housing for rotation about an axis which is substantially parallel to said transverse axis of said housing; and wherein said wheels are in driving contact with said cylindrical cleaning body so as to rotate the same about said axis.

23. A combination as defined in claim 8, wherein said cylindrical cleaning body is a cylindrical brush having bristles which contact the surface to be cleaned.

24. A combination as defined in claim 19, and further comprising a protective cover for closing that end of said frame which faces away from the surface to be cleaned.

25. A combination as defined in claim 24, wherein said protective cover is a sheet-metal profiled element.

26. A combination as defined in claim 25, wherein said profiled element has front and rear marginal portions which are inclined with respect to the remainder of said profiled element; and wherein said frame includes clamping portions which receive and clamp said marginal portions of said profiled element.

27. A combination as defined in claim 25, wherein said profiled element has lateral marginal portions which are inclined with respect to the remainder of said profiled element and which abut against the lateral wall portions of said frame.

28. A combination as defined in claim 19, and further comprising means for connecting said cover to said housing, including elastically yieldable arms having projections which engage in detent recesses with snap action.

29. A combination as defined in claim 19, wherein said housing is of synthetic plastic material.

* * * * *